US012253306B2

(12) United States Patent
Ochiai et al.

(10) Patent No.: US 12,253,306 B2
(45) Date of Patent: Mar. 18, 2025

(54) METHOD AND SYSTEM FOR DETERMINING OPERATING CONDITIONS OF LIQUEFIED NATURAL GAS PLANT

(71) Applicant: Chiyoda Corporation, Yokohama (JP)

(72) Inventors: Takayuki Ochiai, Yokohama (JP); Yoshihiro Yamaguchi, Yokohama (JP)

(73) Assignee: CHIYODA CORPORATION, Kanagawa (JP)

( * ) Notice: Subject to any disclaimer, the term of this patent is extended or adjusted under 35 U.S.C. 154(b) by 382 days.

(21) Appl. No.: 17/762,588

(22) PCT Filed: May 27, 2020

(86) PCT No.: PCT/JP2020/020932

§ 371 (c)(1),
(2) Date: Mar. 22, 2022

(87) PCT Pub. No.: WO2021/240689

PCT Pub. Date: Dec. 2, 2021

(65) Prior Publication Data

US 2022/0333857 A1 Oct. 20, 2022

(51) Int. Cl.
*F25J 1/02* (2006.01)
*F25J 1/00* (2006.01)

(52) U.S. Cl.
CPC ..... *F25J 1/0252* (2013.01); *F25J 1/0022* (2013.01); *F25J 1/0025* (2013.01); *F25J 1/0211* (2013.01);

(Continued)

(58) Field of Classification Search
None
See application file for complete search history.

(56) References Cited

U.S. PATENT DOCUMENTS 4,809,154 A * 2/1989 Newton ..... F25J 1/023 700/28
5,791,160 A * 8/1998 Mandler ..... F25J 1/0052 62/611

(Continued)

FOREIGN PATENT DOCUMENTS

JP 2006516715 A 7/2006
JP 2013540973 A 11/2013

(Continued)

OTHER PUBLICATIONS

International Search Report for Patent Application PCT/JP2020/020932 mailed Aug. 4, 2020; 3 pp.

(Continued)

*Primary Examiner* — Jenna M Maroney
*Assistant Examiner* — Ibrahim A. Michael Adeniji
(74) *Attorney, Agent, or Firm* — Armstrong Teasdale LLP

(57) ABSTRACT

A method for determining an operating condition of a liquefied natural gas plant (2) includes preparing a training model (88) generated by machine learning using training data in which operating conditions data including a composition of a feed gas, a composition of a mixed refrigerant, and an ambient temperature and operation result data including a production efficiency of a liquefied product containing liquefied natural gas and a heavy component of the feed gas are associated together; and determining, as one new operating condition, a composition of the mixed refrigerant that optimizes a production efficiency of the liquefied natural gas predicted by the training model (88) from a latest composition of the feed gas in the liquefied natural gas plant (2) and a latest ambient temperature.

9 Claims, 7 Drawing Sheets

(52) U.S. Cl.
CPC ..... *F25J 1/0249* (2013.01); *F25J 1/0255* (2013.01); *F25J 2280/50* (2013.01)

(56) References Cited

U.S. PATENT DOCUMENTS

| | | | | |
|---|---|---|---|---|
| 2004/0255615 | A1 | 12/2004 | Hupkes et al. | |
| 2010/0326133 | A1* | 12/2010 | Beeby ..... | F25J 1/0052 62/614 |
| 2018/0209724 | A1 | 7/2018 | Repasky et al. | |
| 2018/0356151 | A1 | 12/2018 | Suraganda et al. | |

FOREIGN PATENT DOCUMENTS

| | | | |
|---|---|---|---|
| JP | 6325481 | B2 | 5/2018 |
| JP | 2019028824 | A | 2/2019 |
| RU | 2495343 | C2 | 10/2013 |
| WO | 2017154181 | A1 | 9/2017 |
| WO | 2019017421 | A1 | 1/2019 |

OTHER PUBLICATIONS

Office Action and Search Report for Russian Patent Application No. 2022134235 dated Jul. 3, 2023; 17 pp.
Notice of Reasons for Refusal for Japanese Patent Application No. 2022-527360 dated Jul. 11, 2023; 8 pp.

* cited by examiner

METHOD AND SYSTEM FOR DETERMINING OPERATING CONDITIONS OF LIQUEFIED NATURAL GAS PLANT

CROSS-REFERENCE TO RELATED APPLICATION

This application is a U.S. National Phase Application of PCT/JP2020/020932 filed May 27, 2020, which is hereby expressly incorporated by reference in its entirety.

TECHNICAL FIELD

The present invention relates to a method and a system for determining an operating condition of a liquefied natural gas plant.

BACKGROUND ART

A technology designed to improve the production efficiency of a liquefied product obtained by cooling raw natural gas (hereinafter, referred to as "feed gas") has been developed for liquefied natural gas plants. A known method for controlling the liquefaction process of a methane-rich feed uses an advanced process controller based on model predictive control (see Patent Document 1). In this known method, to optimize the production of the liquefied product, simultaneous control actions are determined for a set of manipulated variables while controlling at least one set of controlled variables. The set of controlled variables includes the temperature difference at the warm end of a main cryogenic heat exchanger and the temperature difference at the mid-point of the main cryogenic heat exchanger. The set of manipulated variables includes the mass flow rate of the heavy refrigerant fraction, the mass flow rate of the light refrigerant fraction, and the mass flow rate of the methane-rich feed.

CITATION LIST

Patent Literature

Patent Document 1: JP 2006-516715 T

SUMMARY OF INVENTION

Technical Problem

In a liquefied natural gas plant, operating conditions that are relatively easy to control need to be optimized in response to changes over time in operating conditions that are relatively difficult to control, in order to improve the production efficiency of the liquefied product. Operating conditions that are relatively difficult to control include the composition and pressure of the feed gas calculated from the gas field, and the ambient temperature. Operating conditions that are relatively easy to control include the composition of the mixed refrigerant used for cooling the feed gas.

As a result of diligent research, the inventors of the present application have created a training model that can accurately predict the production efficiency of a liquefied product under unknown operating conditions. The training model is obtained by performing machine learning using training data in which the operating conditions of the liquefied natural gas plant and the operation results are associated together. In the liquefied natural gas plant, even in a case where operating conditions that are relatively difficult to control have changed, the composition of the mixed refrigerant capable of improving the production efficiency of the liquefied product can be determined in real time by using this training model.

A main object of the present invention is to, in a case where operating conditions of a liquefied natural gas plant that are relatively difficult to control have changed, determine a candidate composition of mixed refrigerant for improving the production efficiency of the liquefied product as one new operating condition.

Solution to Problem

A first aspect of the present invention is a method for determining an operating condition of a liquefied natural gas plant (2) including a main cryogenic heat exchanger (24) configured to generate liquefied natural gas from a light component of a feed gas via heat exchange between the light component and a mixed refrigerant, a tank (57) configured to store the liquefied natural gas, and a compressor (27) configured to be driven using some of the feed gas and the liquefied natural gas as fuel and compress the mixed refrigerant, the method comprising: preparing a training model (88) generated by machine learning using training data in which operating conditions data including a composition of the feed gas, a composition of the mixed refrigerant, and an ambient temperature and operation result data including a production efficiency of the liquefied natural gas are associated together; and determining, as one new operating condition, a composition of the mixed refrigerant that optimizes a production efficiency of the liquefied natural gas predicted by the training model from a latest composition of the feed gas in the liquefied natural gas plant and a latest ambient temperature.

According to this configuration, in a case where the operating conditions of a liquefied natural gas plant have changed, a candidate composition of the mixed refrigerant for improving the production efficiency of the liquefied product can be determined to be one new operating condition.

In a second aspect of the present invention, the production efficiency is a ratio of a sum of an effective flow rate of the liquefied natural gas or an amount of heat converted value of the effective flow rate of the liquefied natural gas and a flow rate of a heavy component of the feed gas or an amount of heat converted value of the flow rate of a heavy component to a flow rate of the feed gas or an amount of heat converted value of the flow rate of the feed gas; and the effective flow rate of the liquefied natural gas is a flow rate obtained by subtracting a flow rate of a boil-off gas of the liquefied natural gas discharged as the fuel from the tank from the flow rate of the liquefied natural gas introduced into the tank.

According to this configuration, with a liquefied natural gas plant provided with a mixed refrigerant compressor driven using some of the feed gas and the liquefied natural gas as fuel, a candidate composition of the mixed refrigerant for enhancing the production efficiency of the liquefied product can be easily determined.

In a third aspect of the present invention, the training data includes at least one of operation data (91) obtained by a previous operation of the liquefied natural gas plant or simulation data (92) obtained on the basis of a simulation model for simulating an operating situation of the liquefied natural gas plant.

According to this configuration, in a case where there is no previous plant operation data or previous plant operation data is insufficient, simulation data can be used as an alternative or a supplement, allowing appropriate training data to be acquired.

In a fourth aspect of the present invention, an operation assistance screen (110) is generated for displaying the operating condition to an operator.

This allows the operator to set a new operating condition for the liquefied natural gas plant while checking the new operating condition on the operation assistance screen. In a fifth aspect of the present invention, the operation assistance screen includes information of a current composition of the mixed refrigerant in the liquefied natural gas plant and information of a candidate composition of the mixed refrigerant determined to be the one new operating condition.

According to this configuration, the operator can easily set a new operating condition for the composition of the mixed refrigerant while simultaneously checking the current composition of the mixed refrigerant and the candidate composition of the mixed refrigerant, which is the goal.

In a sixth aspect of the present invention, the mixed refrigerant includes nitrogen, methane, and propane; and information (115, 116) relating to the nitrogen and the propane are displayed in a highlighted manner on the operation assistance screen.

According to this configuration, the operator can easily set a new operating condition for the composition of the mixed refrigerant while checking the ratio of nitrogen and propane, which are relatively important, in the composition of the mixed refrigerant.

In a seventh aspect of the present invention, the operation assistance screen includes a temperature profile (121) of the light component and the liquefied natural gas in the main cryogenic heat exchanger.

According to this configuration, the operator can easily set a new operating condition for the composition of the mixed refrigerant while checking the temperature profile of the light component and the liquefied natural gas in the main cryogenic heat exchanger.

In an eighth aspect of the present invention, the temperature profile of the light component and the liquefied natural gas in the main cryogenic heat exchanger includes a temperature (122) of an inlet of the main cryogenic heat exchanger where the light component is introduced and a temperature (123) of an outlet of the main cryogenic heat exchanger where the liquefied natural gas is discharged, respectively; and information relating to the temperature of the inlet and the temperature of the outlet is displayed in a highlighted manner on the operation assistance screen.

According to this configuration, the operator can easily set a new operating condition for the temperature of the light component or the liquefied natural gas in the main cryogenic heat exchanger while checking the temperature of the light component or the liquefied natural gas at, from among the units of the main cryogenic heat exchanger, the inlet and the outlet, with the temperatures here being relatively important.

A ninth aspect of the present invention is a system for determining an operating condition (1) of a liquefied natural gas plant (2) including a main cryogenic heat exchanger (24) that generates liquefied natural gas from a light component of a feed gas via heat exchange between the light component and a mixed refrigerant, a tank (57) that stores the liquefied natural gas, and a compressor (27) that is driven using some of the feed gas and the liquefied natural gas as fuel to compress the mixed refrigerant, the system comprising: a processor (101) configured to execute processing to determine an operating condition of the liquefied natural gas plant, wherein the processor is configured to prepare a training model (88) generated by machine learning using training data in which operating conditions data including a composition of the feed gas, a composition of the mixed refrigerant, and an ambient temperature and operation result data including a production efficiency of the liquefied natural gas are associated together and determine, as one new operating condition, a composition of the mixed refrigerant that optimizes a production efficiency of the liquefied natural gas predicted by the training model from a latest composition of the feed gas in the liquefied natural gas plant and a latest ambient temperature.

According to this configuration, in a case where the operating conditions of a liquefied natural gas plant have changed, a candidate composition of the mixed refrigerant for improving the production efficiency of the liquefied product can be determined to be one new operating condition.

Advantageous Effects of Invention

According to the present invention, in a case where the operating conditions of a liquefied natural gas plant that are relatively difficult to control have changed, a candidate composition of the mixed refrigerant for improving the production efficiency of the liquefied product can be determined to be one new operating condition.

DESCRIPTION OF EMBODIMENTS

Embodiments of the present invention are described below with reference to the drawings.

Figure 1:
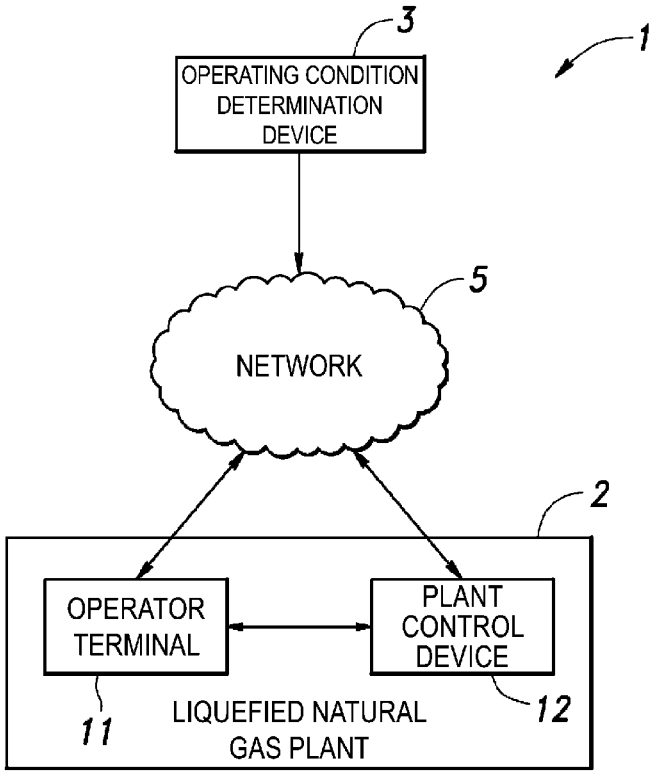
FIG. 1 is a configuration diagram of an operating condition determination system according to an embodiment.

FIG. 1 is a configuration diagram of an operating condition determination system 1 for a liquefied natural gas plant according to an embodiment.

The operating condition determination system 1 includes an operating condition determination device 3 that determines an operating condition of a liquefied natural gas plant (hereinafter, referred to as an "LNG plant") 2. The LNG plant 2 includes a plant facility 20 (see FIG. 2). The LNG plant 2 further includes an operator terminal 11 operated by an operator who operates the plant facility 20. In addition, the LNG plant 2 includes a plant control device 12 that controls the plant facility 20 on the basis of operations of the operator. The operator terminal 11 and the plant control device 12 may constitute a part of the operating condition determination system 1. The LNG plant 2 may include a plurality of the operator terminals 11 and a plurality of the plant control devices 12.

The operator terminal 11 and the plant control device 12 are communicatively connected to one another via a wireless or a wired connection. The operator terminal 11 and the plant control device 12 are each communicatively connected to the operating condition determination device 3 via a network 5. The network 5 is configured of a computer network such as a LAN or a WAN.

Figure 2:
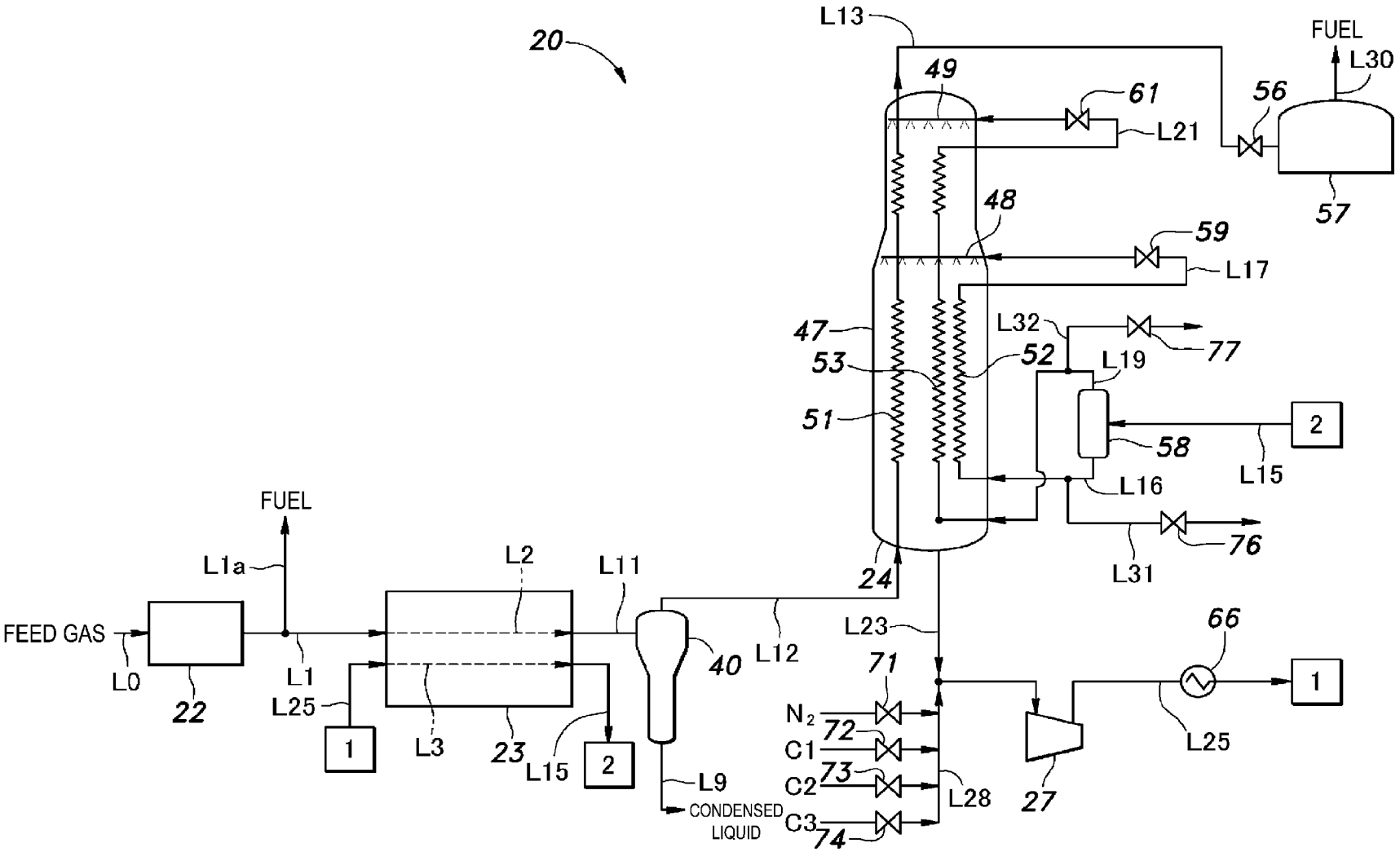
FIG. 2 is a configuration diagram illustrating an example of a plant facility constituting a liquefied natural gas plant.

FIG. 2 is a configuration diagram illustrating an example of the plant facility 20 constituting the liquefied natural gas plant 2.

The plant facility 20 liquefies feed gas produced from a gas well. The feed gas produced from the gas well contains from about 80 to 98 mol % of methane, hydrocarbons such as ethane, propane and butane, nitrogen, and other impurities. The composition and pressure of the produced feed gas varies over time depending on the properties of each gas well and the residual amount in each gas well. The feed gas introduced into the plant facility 20 is preprocessed by a preprocessing facility 22. The preprocessing facility 22 includes a condensate removal apparatus, a mercury removal apparatus, an acid gas removal apparatus, a dehydration apparatus, and the like. The condensate removal apparatus removes the hydrocarbons in a liquid state from the feed gas. The mercury removal apparatus removes mercury from the feed gas. The acid gas removal apparatus removes acid gases such as H2S, CO2, and organic sulfur from feed gas. The dehydration apparatus removes moisture from the feed gas.

The plant facility 20 includes a precooling facility 23, a main cryogenic heat exchanger 24, and a mixed refrigerant compressor 27 (hereinafter, referred to simply as "compressor"). The precooling facility 23 cools the preprocessed feed gas and a mixed refrigerant by a precooling refrigerant. The main cryogenic heat exchanger 24 uses the mixed refrigerant to liquefy the feed gas cooled by the precooling facility 23. The compressor 27 compresses the mixed refrigerant gas after heat exchange. The compressor 27 includes a gas turbine as a driver. However, the compressor 27 may include an electric motor as an auxiliary driver.

The C3-MR (C3-MR: propane (C3) pre-cooled mixed refrigerant) system is employed in the plant facility 20. In the plant facility 20, the feed gas is precooled by the precooling refrigerant in the precooling facility 23, and the feed gas is liquefied and subcooled to a very low temperature by a mixed refrigerant in the main cryogenic heat exchanger 24.

The main component of the precooling refrigerant is propane. The mixed refrigerant contains nitrogen, methane, and propane. The mixed refrigerant may further contain ethane or ethylene. The composition of the mixed refrigerant corresponds to the mixing ratio of these components and can be discretionarily changed within a predetermined range.

The feed gas preprocessed by the preprocessing facility 22 is supplied to the precooling facility 23 via a line L1. In the precooling facility 23, the feed gas is cooled to approximately −30° C. by the precooling refrigerant. Some of the feed gas preprocessed by the preprocessing facility 22 flows into a line L1*a* that branches off from the line L1. The feed gas flowing through the line L1*a* is used as fuel for a gas turbine for driving (not illustrated) provided in the compressor 27.

The feed gas passed through the precooling facility 23 is introduced to the separation facility 40 via a line L11. The separation facility 40 includes, for example, a scrub column. In the separation facility 40, a heavy component is separated from a light component, including methane. The heavy component of the feed gas is discharged as a condensed liquid from a column bottom portion of the separation facility 40 via a line L9. This condensed liquid is a part of the liquefied product produced in the LNG plant 2. The heavy component of the condensed liquid is mainly a component with a high boiling point, such as benzene or a C5+ hydrocarbon having a relatively high freezing point. However, the heavy component may contain a C2+ hydrocarbon other than methane or the like. The light component of the feed gas is discharged from a column top portion of the separation facility 40.

The light component of the feed gas discharged from the separation facility 40 is introduced into a column bottom portion of the main cryogenic heat exchanger 24 via a line L12. The main cryogenic heat exchanger 24 is a spool wound heat exchanger housed in a shell 47 in a state in which a bundle of heat transfer tubes through which the light component of the feed gas and the mixed refrigerant flow are wound into a coil shape. Inside the shell 47, the liquid mixed refrigerant supplied from first and second spray headers 48 and 49 to be described below flows toward the column bottom portion. The main cryogenic heat exchanger 24 has a warm temperature region and a cold temperature region in this order from the column bottom portion to the column top portion, and the temperature decreases from the column bottom portion toward the column top portion. The heat transfer tubes in the shell 47 include a first heat transfer tube 51 through which the feed gas flows and second and third heat transfer tubes 52 and 53 through which the mixed refrigerant flows.

The line L12 is connected to a lower end of the first heat transfer tube 51 at the column bottom portion of the main cryogenic heat exchanger 24. The first heat transfer tube 51 extends from the column bottom portion to the column top portion of the main cryogenic heat exchanger 24. The light component of the feed gas is liquefied and subcooled in the first heat transfer tube 51. An upper end of the first heat transfer tube 51 is connected to an LNG tank 57 for storage via a line L13. The line L13 includes a first expansion valve 56. The light component of the feed gas liquefied in the first heat transfer tube 51 (hereinafter, referred to as "LNG") is expanded at the first expansion valve 56 and then sent to the LNG tank 57. The LNG stored in the LNG tank 57 is a part of the liquefied product produced in the LNG plant 2. The temperature of the LNG after passing through the first expansion valve 56 is from approximately −150 to 160° C.

A BOG discharge line L30 for discharging boil-off gas is provided in the LNG tank 57. The boil-off gas includes LNG vaporized by expansion at the first expansion valve 56 and LNG vaporized inside the LNG tank 57. The downstream side of the BOG discharge line L30 is connected to the line L1*a*. Thus, the boil-off gas flowing through the BOG discharge line L30 is mixed with the feed gas flowing through the line L1*a*, and this mixture is used as fuel for a gas turbine for driving provided in the compressor 27. In the present embodiment, the fuel for driving the compressor 27 is not supplied from outside of the LNG plant 2, and only the feed gas and the boil-off gas is used.

In the plant facility 20, the boil-off gas flowing through the BOG discharge line L30 is preferentially used as the fuel for the gas turbine, and thus the amount of the feed gas used as fuel, that is, the amount of feed gas flowing through the line L1*a*, is preferably as small as possible. This makes it possible to improve the production efficiency of the LNG plant 2 to be described below. On the other hand, in the plant facility 20, it is necessary to adjust the amount of boil-off gas flowing through the BOG discharge line L30 so as to not exceed the required amount of fuel. This makes it possible to reduce the amount of boil-off gas to be combusted and improve the production efficiency of the LNG plant 2.

Next, the flow of the mixed refrigerant in the plant facility 20 will be described. A partially liquefied high pressure mixed refrigerant in the precooling facility 23 is supplied to a refrigerant separator 58 via a line L15. The refrigerant separator 58 separates the mixed refrigerant into a gas phase component and a liquid phase component. A line L16 connects the refrigerant separator 58 and the second heat transfer tube 52. The liquid mixed refrigerant separated in the refrigerant separator 58 is supplied to a lower end of the second heat transfer tube 52 via the line L16. The second heat transfer tube 52 extends from the column bottom portion of the main cryogenic heat exchanger 24 to the warm temperature region. An upper end of the second heat transfer tube 52 is connected to the first spray header 48 via a line L17. The line L17 includes a second expansion valve 59. The liquid mixed refrigerant flows upward in the second heat transfer tube 52 and then expands at the second expansion valve 59, with some of the mixed refrigerant being flash evaporated.

The mixed refrigerant that passed through the second expansion valve 59 is discharged downward from the first spray header 48. The mixed refrigerant discharged from the first spray header 48 flows countercurrent to the flow of the feed gas in the main cryogenic heat exchanger 24. The mixed refrigerant flows downward with heat exchange occurring between the light component of the feed gas flowing in the first to third heat transfer tubes 51 to 53 and the mixed refrigerant.

The gas phase component of the mixed refrigerant separated in the refrigerant separator 58 is supplied to a lower end of the third heat transfer tube 53 via a line L19 that connects the refrigerant separator 58 and the third heat transfer tube 53. The third heat transfer tube 53 extends from the column bottom portion of the main cryogenic heat exchanger 24 to the cold temperature region. An upper end of the third heat transfer tube 53 is connected to the second spray header 49 via a line L21. The line L21 includes a third expansion valve 61. The mixed refrigerant flows upward in the third heat transfer tube 53 and then expands at the third expansion valve 61, with some of the mixed refrigerant being flash evaporated.

The temperature of the mixed refrigerant that passed through the third expansion valve 61 is lower than the temperature of the LNG before passing through the first expansion valve 56. The mixed refrigerant that passed through the third expansion valve 61 is discharged downward from the second spray header 49 disposed at an upper portion of the cold temperature region. The mixed refrigerant discharged from the second spray header 49 flows countercurrent to the flow of the feed gas in the main cryogenic heat exchanger 24. The mixed refrigerant flows downward with heat exchange occurring with the upper tube bundle consisting of the first and third heat transfer tubes 51 and 53 disposed in the cold temperature region. Thereafter, the mixed refrigerant discharged from the second spray header 49 is mixed with the mixed refrigerant discharged from the first spray header 48 disposed below, and this mixture flows downward with heat exchange occurring with the first to third heat transfer tubes 51 to 53. The mixed refrigerant discharged from the first and second spray headers 48 and 49 into the main cryogenic heat exchanger 24 is discharged as a low-pressure mixed refrigerant gas from the column bottom portion of the main cryogenic heat exchanger 24. The low-pressure mixed refrigerant is, for example, −40° C. and has a pressure of 3.5 bara. A discharge port for the mixed refrigerant formed in the column bottom portion of the main cryogenic heat exchanger 24 is connected to an inlet port of the compressor 27 via a line L23. An outlet port of the compressor 27 is connected to a line L3 of the precooling facility 23 via a line L25. A cooler 66 is provided on the line L25. The cooler 66 is an air-cooled heat exchanger.

The mixed refrigerant discharged from the column bottom portion of the main cryogenic heat exchanger 24 is supplied to the precooling facility 23 through the compressor 27 and the cooler 66. At this time, the mixed refrigerant is pressurized in the compressor 27. Also, the mixed refrigerant is cooled in the cooler 66. Thereafter, the mixed refrigerant is cooled by the precooling refrigerant in the precooling facility 23 to become partially liquefied, and is then supplied to the refrigerant separator 58 again via the line L15.

A replenishment line L28 for replenishing the feed of the mixed refrigerant is connected to a portion of the line L23 between the main cryogenic heat exchanger 24 and the compressor 27. Supply sources of the plurality of feeds that compose the mixed refrigerant are connected to the replenishment line L28. The components, i.e., feeds, of the mixed refrigerant are nitrogen ($N_2$), methane (C1), ethane (C2), and propane (C3). Make up valves 71 to 74 are provided between each supply source and the replenishment line L28. By changing the degree of opening of each make up valve 71 to 74, the replenishment amount of each component constituting the mixed refrigerant can be adjusted.

A first extraction line L31 for extracting the liquid mixed refrigerant to the outside is connected to the line L16 that connects the refrigerant separator 58 and the second heat transfer tube 52. A second extraction line L32 for extracting the gaseous mixed refrigerant to the outside is connected to the line L19 that connects the refrigerant separator 58 and the third heat transfer tube 53. Vent valves 76 and 77 are provided in the first extraction line L31 and the second extraction line L32. By adjusting the degree of opening of each vent valve 76 and 77, the extraction amounts of the liquid mixed refrigerant and the gaseous mixed refrigerant can be adjusted.

The operator can adjust the amount of refrigerant present in the system, this amount being a factor in determining the composition and the pressure of the mixed refrigerant, by adjusting the make up valves 71 to 74 and the vent valves 76 and 77.

The plant facility 20 is provided with a thermometer that measures the temperature of the feed gas, the mixed refrigerant, and the precooling refrigerant. Also, the plant facility 20 is provided with a pressure gauge, a flow meter, and a composition analyzer for the feed gas, the mixed refrigerant, and the precooling refrigerant. The plant facility 20 is also provided with a thermometer that measures the ambient temperature. The thermometer, the pressure gauge, the flow meter, and the composition analyzer each include a controller and/or a monitor.

The thermometer, the pressure gauge, the flow meter, and the composition analyzer output signals corresponding to measurement values to the plant control device 12 (see FIG. 1). The plant control device 12 controls the compressor 27, the first to third expansion valves 56, 59, and 61, the make up valves 71 to 74, and the vent valves 76 and 77.

Figure 3:
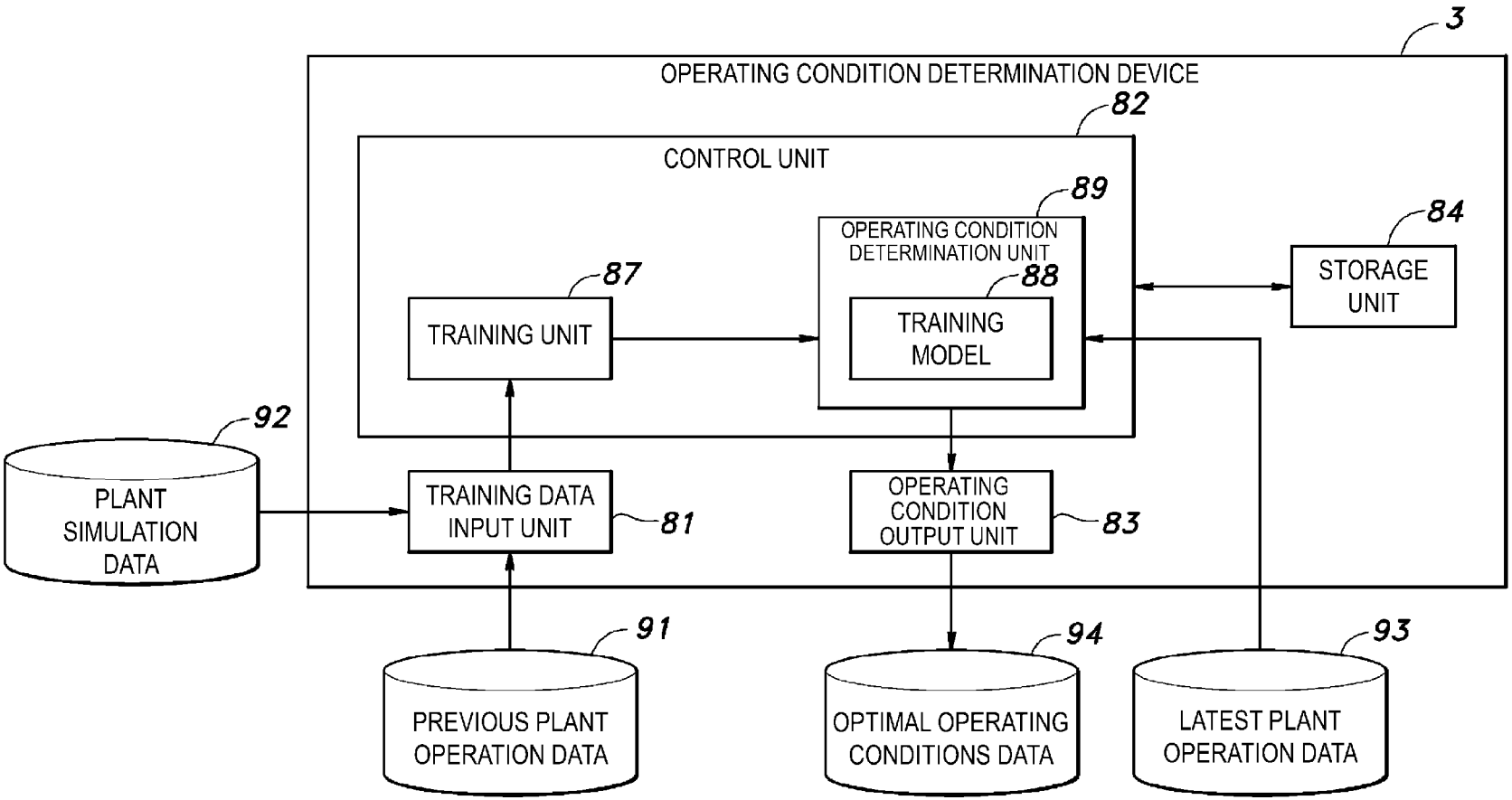
FIG. 3 is a functional block diagram of an operating condition determination device.
Figure 4:
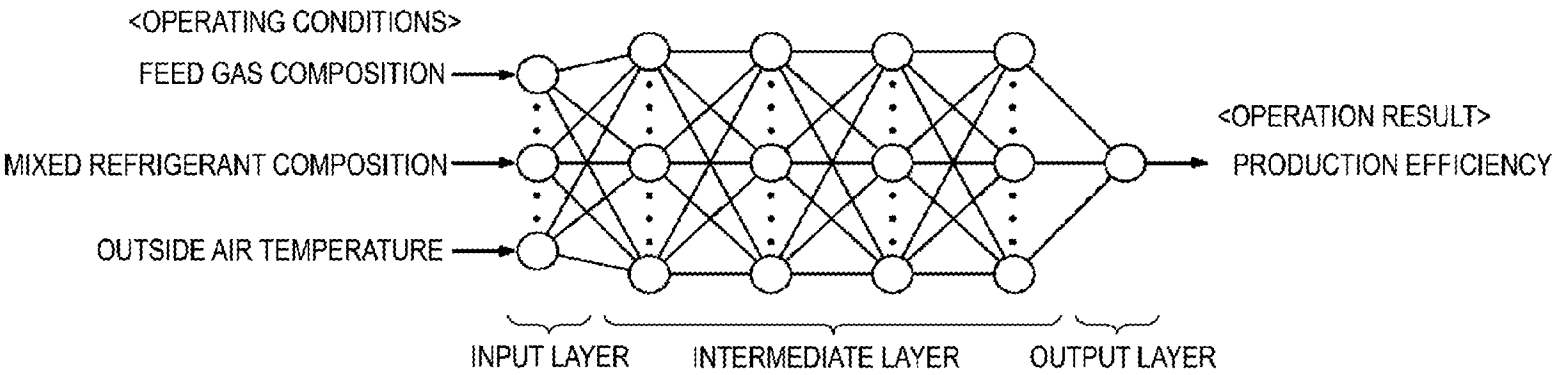
FIG. 4 is an explanatory diagram of the training executed by a training unit.

FIG. 3 is a functional block diagram of the operating condition determination device 3. FIG. 4 is an explanatory diagram of the training executed by a training unit 87.

The operating condition determination device 3 includes a training data input unit 81, a control unit 82, an operating condition output unit 83, and a storage unit 84. The storage unit 84 stores various types of data and programs used in the processing of the operating condition determination device 3.

Previous plant operation data 91 of the LNG plant 2 is input into the training data input unit 81. As the previous plant operation data 91, previous operation data stored in the plant control device 12 can be used. The previous plant operation data 91 includes operating conditions data including the composition of the feed gas, the composition of the mixed refrigerant, and the ambient temperature, and operation result data including the production efficiency of the LNG plant 2. The operating conditions data is not limited to the ambient temperature and may include other weather conditions such as atmospheric pressure. In a case where an air-cooled heat exchanger is used to cool the precooling refrigerant and the mixed refrigerant, the outside air temperature is defined as the ambient temperature. In a case where a water-cooled heat exchanger is used to cool the precooling refrigerant and the mixed refrigerant, the temperature of the water used for cooling or sea water is defined as the ambient temperature.

The production efficiency is calculated using the following Equations (1) and (2).

$$\text{Production efficiency}=(H_L+H_C)/H_F \quad (1)$$

$$H_L=h_T-h_B \quad (2)$$

$H_L$: Amount of heat converted value (kJ/h) of the effective mass flow rate of the LNG produced in the LNG plant 2.

$H_C$: Amount of heat converted value (kJ/h) of the mass flow rate of the heavy component of the feed gas separated in the separation facility 40 (see L9 in FIG. 2).

$H_F$: Amount of heat converted value (kJ/h) of the mass flow rate of the feed gas (see L0 in FIG. 2).

$h_T$: Amount of heat converted value (kJ/h) of the mass flow rate of the LNG introduced into the LNG tank 57 (see L13 in FIG. 2).

$h_B$: Amount of heat converted value (kJ/h) of the mass flow rate of the boil-off gas of the LNG discharged as fuel from the LNG tank 57 (see L30 in FIG. 2).

The production efficiency is the ratio of the sum of the amount of heat converted value of the effective mass flow rate of the LNG produced in the LNG plant 2 and the amount of heat converted value of the mass flow rate of the heavy component to the amount of heat converted value of the mass flow rate of the feed gas. The effective mass flow rate of the LNG produced in the LNG plant 2 is a mass flow rate obtained by subtracting the mass flow rate of the boil-off gas of the LNG discharged as fuel from the LNG tank 57 from the mass flow rate of the LNG introduced into the LNG tank 57. A value obtained by integrating the mass flow rate and the lower heating value can be used in the amount of heat converted value. However, indicators other than those in Equations (1) and (2) can be used as the production efficiency. Also, for $H_L$, $H_C$, $H_F$, $h_T$, and $h_B$ used in calculating the production efficiency, the mass flow rate can be used in place of the amount of heat converted value of the mass flow rate.

There are cases where the previous plant operation data 91 cannot cover all of the operating conditions that can be employed in the LNG plant 2. In such cases, plant simulation data 92 acquired by using a process simulator is input into the training data input unit 81 as necessary. The plant simulation data 92 includes data similar to the previous plant operation data 91. In a case where there is no previous plant operation data, the plant simulation data 92 is used instead of the previous plant operation data. Also, in a case where there is insufficient previous plant operation data, the previous plant operation data is supplemented with the plant simulation data 92. Thereafter, at least one of the previous plant operation data 91 or the plant simulation data 92 is input into the training unit 87 of the control unit 82.

The training unit 87 generates a training model 88 by performing machine learning with training data. The training unit 87 uses the above-described previous plant operation data 91 and plant simulation data 92 as training data.

More specifically, the training unit 87 includes a deep training model including a multilayer neural network, as illustrated in FIG. 4. In the input layer, the operating conditions data of the LNG plant 2 is input as an explanatory variable. The operating conditions data includes the feed gas composition, the mixed refrigerant composition, and the ambient temperature. In the output layer, the operation result data of the LNG plant 2 is output as a target variable. The operation result data includes the production efficiency. The production efficiency included in the previous plant operation data 91 and the plant simulation data 92 is used as a correct answer label. In the training unit 87, the weighting of each node included in each layer can be adjusted on the basis of the error between the value of the correct answer label and the output value.

The operating condition determination device 3 does not necessarily need to generate the training model 88 by itself. The operating condition determination device 3 may not be provided with the training unit 87 and may use the training model 88 generated by another device. Alternatively, the operating condition determination device 3 may employ another machine training model, such as a support-vector machine or a random forest.

An operating condition determination unit 89 of the control unit 82 executes operating condition determination processing. As described in detail below (see FIG. 5), the operating condition determination unit 89 predicts the production efficiency using the training model 88 from unknown data of a plurality of operating conditions.

The unknown data of the operating conditions is a combination of latest plant operation data 93 and data of candidate compositions of the mixed refrigerant. The data of the candidate compositions of the mixed refrigerant is prepared in advance as data that falls within the appropriate numerical range for each composition and is stored in the storage unit 84.

The operating condition determination unit 89 determines a new operating condition including the optimal mixed refrigerant composition on the basis of the prediction result of the production efficiency.

The operating condition output unit 83 outputs data of the new operating condition determined by the operating condition determination unit 89 as optimal operating conditions data 94.

The operator terminal 11 can acquire the optimal operating conditions data 94 output from the operating condition determination unit 89 via the network 5. A display device of the operator terminal 11 can display an operation assistance screen 110 (see FIG. 7 described below) for the operator on the basis of the optimal operating conditions data 94. At this time, the operator can set operation amounts of the plant facility 20 in accordance with the display of the operation assistance screen 110 in order to operate the plant facility 20 at optimal operating conditions. For example, the operator can set the degrees of opening of the make up valves 71 to 74 to optimize the composition of the mixed refrigerant, which is one of the operating conditions.

Alternatively, the plant control device 12 can acquire the optimal operating conditions data 94 output from the operating condition determination unit 89 via the network 5. The plant control device 12 can automatically set each operation amount of the plant facility 20 on the basis of the optimal operating conditions data 94, as opposed to each operation amount being set by an operator operation.

Figure 5:
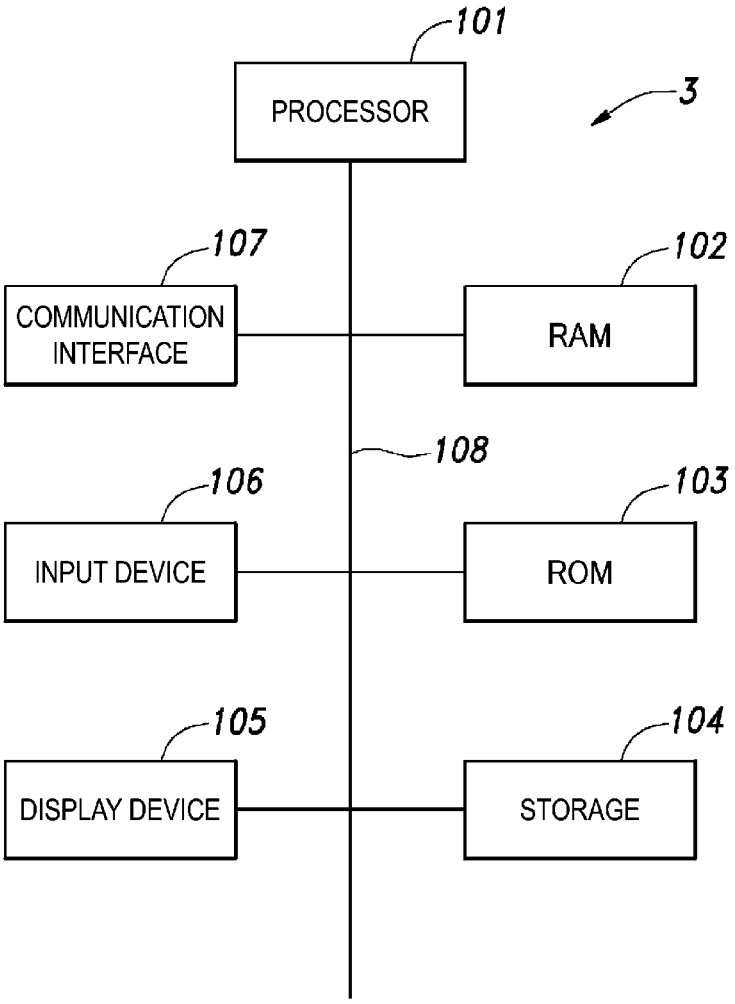
FIG. 5 is a block diagram illustrating the hardware configuration of the operating condition determination device.

FIG. 5 is a block diagram illustrating the hardware configuration of the operating condition determination device 3.

The operating condition determination device 3 includes a processor 101 such as a central processing unit (CPU) that comprehensively executes operating condition determination on the basis of a predetermined control program. In addition, the operating condition determination device 3 includes a random access memory (RAM) 102 that functions as the working area of the processor 101 and a read-only memory (ROM) 103 that stores programs executed by the processor 101. The operating condition determination device 3 includes a storage 104 comprised of a hard disk drive (HDD) or the like, a display device 105 comprised of a liquid crystal monitor or the like, and an input device 106 comprised of a keyboard, a mouse, a touch panel, and the like. The operating condition determination device 3 includes a communication interface 107 that controls communication with another device via the network 5. The components 101 to 107 of the operating condition determination device 3 are connected to one another via a bus 108.

An information processing device, such as a PC or a server, can be used as the operating condition determination device 3. At least some of the functions of the operating condition determination device 3 illustrated in FIGS. 3 and 4 can be realized by the processor 101 executing a control program.

Note that an information processing device having a hardware configuration similar to that of the operating condition determination device 3 can be used as the operator terminal 11 and the plant control device 12. At least some of the functions of the operator terminal 11 and the plant control device 12 can be implemented by the processor executing a control program. The operator terminal 11 may be integrally formed with the plant control device 12.

Figure 6:
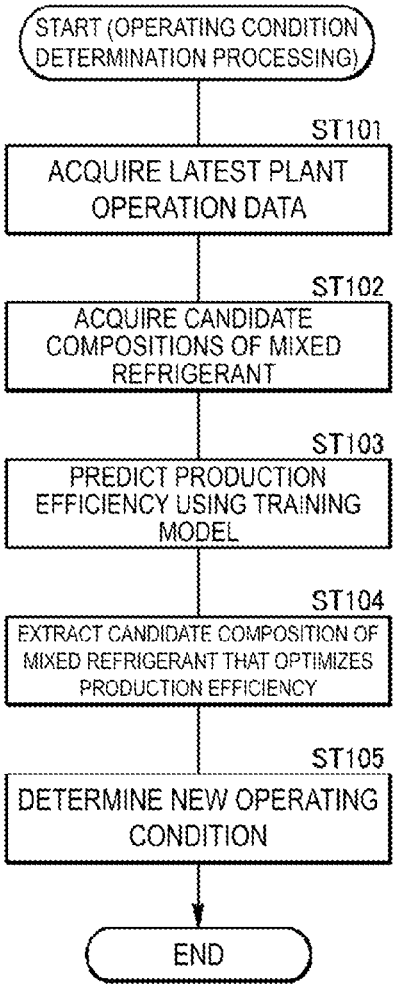
FIG. 6 is a flowchart illustrating the flow of operating condition determination processing executed by an operating condition determination unit.

FIG. 6 is a flowchart illustrating the flow of the operating condition determination processing executed by the operating condition determination unit 89.

In the operating condition determination processing, the operating condition determination unit 89 acquires the latest plant operation data 93 (step ST101). The latest plant operation data 93 includes operating conditions data including the composition of the feed gas, the composition of the mixed refrigerant, and the ambient temperature for the LNG plant 2.

Next, the operating condition determination unit 89 acquires the data of the plurality of candidate compositions of the mixed refrigerant (step ST102). At this time, the latest plant operation data 93 excluding the composition of the mixed refrigerant and the data of each candidate composition of the mixed refrigerant are combined to generate unknown data for a plurality of operating conditions.

Here, the operating condition determination unit 89 predicts a production efficiency for each piece of operating condition unknown data using the training model 88 (step ST103). Next, the operating condition determination unit 89 selects the maximum production efficiency from the plurality of production efficiencies predicted in step ST103 and extracts a candidate composition of the mixed refrigerant included in the unknown data that corresponds to the maximum production efficiency (step ST104). Furthermore, the operating condition determination unit 89 determines the optimal operating conditions including the candidate composition of the mixed refrigerant extracted in step ST104 (step ST105).

Figure 7:
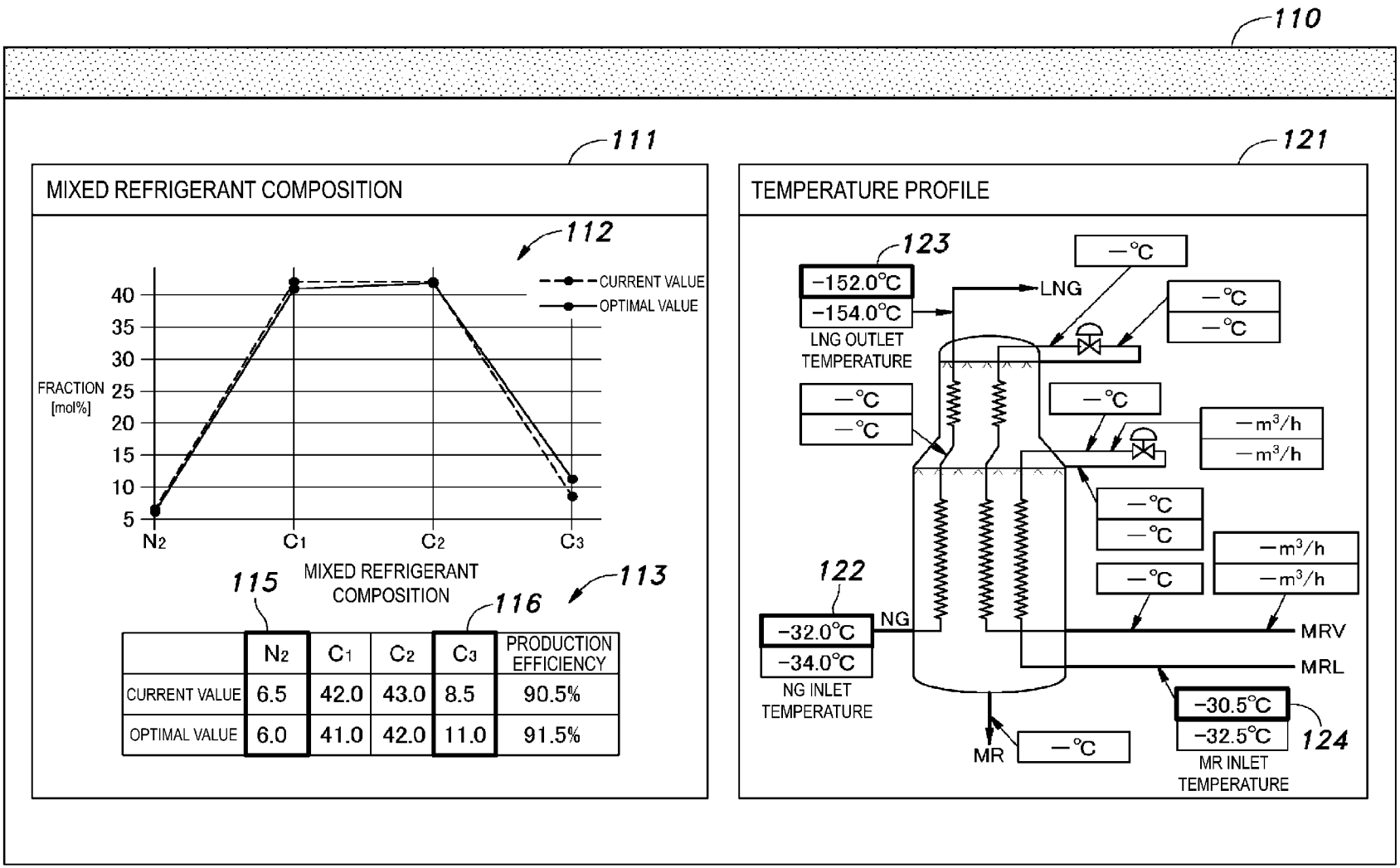
FIG. 7 is an explanatory diagram illustrating an example of an operation assistance screen displayed on an operator terminal.

The optimal operating conditions may include the temperatures of the feed gas and the LNG in the latest plant operation data 93 and the temperature of the mixed refrigerant. The operating condition determination unit 89 can calculate these temperatures from a predetermined relational formula on the basis of the candidate composition of the mixed refrigerant included in the optimal operating conditions. The temperatures constitute a candidate temperature profile for the feed gas and the LNG and the mixed refrigerant in the main cryogenic heat exchanger 24. FIG. 7 is an explanatory diagram illustrating an example of the operation assistance screen 110 displayed on the operator terminal 11.

The operation assistance screen 110 includes a first display region 111 that displays data relating to the mixed refrigerant composition. The first display region 111 includes a line graph 112 indicating the mol percentage (mol %) of nitrogen, methane, ethane, and propane contained in the mixed refrigerant. The line graph 112 includes the current values and the optimal values of the mixed refrigerant composition. The optimal value of the mixed refrigerant composition is a value included in the optimal operating conditions data 94 acquired from the operating condition determination device 3. Also, the first display region 111 includes a composition table 113 indicating the values of the mol percentage (mol %) of nitrogen, methane, ethane, and propane contained in the mixed refrigerant. In the composition table 113, the current values and the optimal values of the mixed refrigerant composition are displayed in two rows above and below one another.

In the operation assistance screen 110, information relating to nitrogen ($N_2$) and propane (C3), which are particularly important components in the mixed refrigerant, is preferably displayed in a highlighted manner. In the composition table 113, a display field 115 for nitrogen ($N_2$) and a display field 116 for propane (C3) are displayed in a highlighted manner with a bold frame. The highlighting may include coloring the display fields 115 and 116 or enlarging the displayed characters and numerical values.

The operation assistance screen 110 includes a second display region 121 that displays the temperature profile of the main cryogenic heat exchanger 24. In the second display region 121, for each unit, the temperature of the light component of the feed gas or the LNG and the current value and the optimal value for the temperature of the mixed refrigerant are displayed in two rows above and below one another. In addition, in the second display region 121, for each unit, the current value and the optimal value for the temperature and flow rate of the mixed refrigerant are displayed in two rows above and below one another. The optimal value for each temperature and each flow rate is a value included in the optimal operating conditions data 94 acquired from the operating condition determination device 3.

Note that the data displayed on the operation assistance screen 110 other than the data relating to the mixed refrigerant composition may be calculated by the operator terminal 11 or the plant control device 12 without using the optimal operating conditions data 94 acquired from the operating condition determination device 3.

Additionally, in the second display region 121, the optimal values of an inlet temperature 122 and an outlet temperature 123 of the feed gas or the LNG and an inlet temperature 124 of the mixed refrigerant (MR) are displayed in a highlighted manner with a bold frame, indicating that they are particularly important operating conditions.

In this manner, on the operation assistance screen 110, the current values and the optimal values of the mixed refrigerant composition and the temperature profiles of the light component of the feed gas, the LNG and the mixed refrigerant in the main cryogenic heat exchanger 24 are displayed. Accordingly, the operator can set the mixed refrigerant composition, the flow rate, and the like to bring the current value of the mixed refrigerant composition closer to the optimal value while confirming both temperature profiles.

Although the present invention has been described using specific embodiments, these embodiments are merely illustrative, and the present invention is not limited by these embodiments. The components of the method and system for determining an operating condition of a liquefied natural gas plant according to the present invention described above in the embodiments are not all necessary and can be appropriately selected by at least a person having skill in the art without departing from the scope of the present invention.

1 Operating condition determination system
2 Liquefied natural gas plant
3 Operating condition determination device
5 Network
10 Operation assistance screen
11 Operator terminal
12 Plant control device
20 Plant facility
22 Preprocessing facility
23 Precooling facility
24 Main cryogenic heat exchanger
27 Mixed refrigerant compressor
40 Separation facility
47 Shell
48 First spray header
49 Second spray header
51 First heat transfer tube
52 Second heat transfer tube
53 Third heat transfer tube
56 First expansion valve
57 LNG tank
58 Refrigerant separator
59 Second expansion valve
61 Third expansion valve
65 Third cooler
66 Cooler
71 to 74 Make up valve
76 to 77 Vent valve
81 Training data input unit
82 Control unit
83 Operating condition output unit
84 Storage unit
87 Training unit
88 Training model
89 Operating condition determination unit
91 Plant operation data
92 Plant simulation data
93 Plant operation data
94 Optimal operating conditions data
101 Processor
104 Storage
105 Display device
106 Input device
107 Communication interface
108 Bus
110 Operation assistance screen
122 Mixed refrigerant inlet temperature
123 LNG outlet temperature
124 Feed gas light component inlet temperature

The invention claimed is:

1. A method for determining an operating condition of a liquefied natural gas plant including a main cryogenic heat exchanger configured to generate liquefied natural gas from a light component of a feed gas via heat exchange between the light component and a mixed refrigerant, a tank configured to store the liquefied natural gas, and a compressor configured to be driven using some of the feed gas and the liquefied natural gas as fuel and compress the mixed refrigerant, the method comprising:

preparing a training model generated by machine learning using training data in which operating conditions data including a composition of the feed gas, a composition of the mixed refrigerant, and an ambient temperature and operation result data including a production efficiency of the liquefied natural gas are associated together; the training data including plant operation data obtained by a previous operation of the liquefied natural gas plant, in a case where there is insufficient plant operation data, the plant operation data being supplemented with the plant simulation data obtained on the basis of a simulation model for simulating an operating situation of the liquefied natural gas plant; and determining, as one new operating condition, a composition of the mixed refrigerant that optimizes a production efficiency of the liquefied natural gas predicted by the training model from a latest composition of the feed gas in the liquefied natural gas plant and a latest ambient temperature, wherein an operation assistance screen is generated for displaying the operating condition to an operator, the operation assistance screen includes a temperature profile of the light component and the liquefied natural gas in the main cryogenic heat exchanger, and the operation assistance screen includes a display region that displays the temperature profile of the main cryogenic heat exchanger, and a current value and an optimal value for temperatures of the light component, the liquefied natural gas, and mixed refrigerant gas are displayed in two rows above and below one another in the display region.

2. The method according to claim 1, wherein the production efficiency is a ratio of a sum of an effective flow rate of the liquefied natural gas or an amount of heat converted value of the effective flow rate of the liquefied natural gas and a flow rate of a heavy component of the feed gas or an amount of heat converted value of the flow rate of a heavy component to a flow rate of the feed gas or an amount of heat converted value of the flow rate of the feed gas; and the effective flow rate of the liquefied natural gas is a flow rate obtained by subtracting a flow rate of a boil-off gas of the liquefied natural gas discharged as the fuel from the tank from the flow rate of the liquefied natural gas introduced into the tank.

3. The method according to claim 1, wherein the operation assistance screen includes information of a current composition of the mixed refrigerant in the liquefied natural gas plant and information of a candidate composition of the mixed refrigerant determined to be the one new operating condition.

4. The method according to claim 3, wherein the mixed refrigerant includes nitrogen, methane, and propane, and information relating to the nitrogen and the propane are displayed in a highlighted manner on the operation assistance screen.

5. A system for determining an operating condition of a liquefied natural gas plant including a main cryogenic heat exchanger configured to generate liquefied natural gas from a light component of a feed gas via heat exchange between the light component and a mixed refrigerant, a tank configured to store the liquefied natural gas, and a compressor configured to be driven using some of the feed gas and the liquefied natural gas as fuel and compress the mixed refrigerant, the system comprising:

a processor configured to execute processing to determine an operating condition of the liquefied natural gas plant, wherein the processor is configured to:

prepare a training model generated by machine learning using training data in which operating conditions data including a composition of the feed gas, a composition of the mixed refrigerant, and an ambient temperature and operation result data including a production efficiency of the liquefied natural gas are associated together, the training data including plant operation data obtained by a previous operation of the liquefied natural gas plant, in a case where there is insufficient plant operation data, the plant operation data being supplemented with the plant simulation data obtained on the basis of a simulation model for simulating an operating situation of the liquefied natural gas plant, and determine, as one new operating condition, a composition of the mixed refrigerant that optimizes a production efficiency of the liquefied natural gas predicted by the training model from a latest composition of the feed gas in the liquefied natural gas plant and a latest ambient temperature, wherein an operation assistance screen is generated for displaying the operating condition to an operator, the operation assistance screen includes a temperature profile of the light component and the liquefied natural gas in the main cryogenic heat exchanger, and the operation assistance screen includes a display region that displays the temperature profile of the main cryogenic heat exchanger, and a current value and an optimal value for temperatures of the light component, the liquefied natural gas, and mixed refrigerant gas are displayed in two rows above and below one another in the display region.

6. The system according to claim 5, wherein the production efficiency is a ratio of a sum of an effective flow rate of the liquefied natural gas or an amount of heat converted value of the effective flow rate of the liquefied natural gas and a flow rate of a heavy component of the feed gas or an amount of heat converted value of the flow rate of a heavy component to a flow rate of the feed gas or an amount of heat converted value of the flow rate of the feed gas; and the effective flow rate of the liquefied natural gas is a flow rate obtained by subtracting a flow rate of a boil-off gas of the liquefied natural gas discharged as the fuel from the tank from the flow rate of the liquefied natural gas introduced into the tank.

7. The system according to claim 5, wherein the operation assistance screen includes information of a current composition of the mixed refrigerant in the liquefied natural gas plant and information of a candidate composition of the mixed refrigerant determined to be the one new operating condition.

8. The system according to claim 7, wherein the mixed refrigerant includes nitrogen, methane, and propane, and information relating to the nitrogen and the propane are displayed in a highlighted manner on the operation assistance screen.

9. The system according to claim 5, wherein the temperature profile of the light component and the liquefied natural gas in the main cryogenic heat exchanger includes a temperature of an inlet of the main cryogenic heat exchanger where the light component is introduced and a temperature of an outlet of the main cryogenic heat exchanger where the liquefied natural gas is discharged, respectively, and information relating to the temperature of the inlet and the temperature of the outlet is displayed in a highlighted manner on the operation assistance screen.

* * * * *